US009134007B2

(12) United States Patent
Wang et al.

(10) Patent No.: US 9,134,007 B2
(45) Date of Patent: Sep. 15, 2015

(54) LIGHT SOURCE DEVICE

(71) Applicant: BriView Corporation, Taoyuan (TW)

(72) Inventors: Chun-Lin Wang, Taichung (TW); Yu-Shan Shen, Taichung (TW); Chung-Hsing Chang, Taichung (TW)

(73) Assignee: Darwin Precisions Corporation, Taichung (TW)

( * ) Notice: Subject to any disclaimer, the term of this patent is extended or adjusted under 35 U.S.C. 154(b) by 381 days.

(21) Appl. No.: 13/669,615

(22) Filed: Nov. 6, 2012

(65) Prior Publication Data

US 2014/0126222 A1 May 8, 2014

(51) Int. Cl.
*F21V 5/04* (2006.01)
*F21Y 101/02* (2006.01)

(52) U.S. Cl.
CPC ..... *F21V 5/043* (2013.01); *F21V 5/046* (2013.01); *F21V 5/04* (2013.01); *F21Y 2101/02* (2013.01)

(58) Field of Classification Search
CPC ..... F21V 5/04; F21V 5/043; F21V 5/048; G02B 27/04; G02B 27/0966
USPC ..... 362/311.01–311.15, 326, 322, 249.02
See application file for complete search history.

(56) References Cited

U.S. PATENT DOCUMENTS

| | | | | |
|---|---|---|---|---|
| 4,703,405 | A | 10/1987 | Lewin | |
| 7,348,723 | B2 | 3/2008 | Yamaguchi et al. | |
| 7,431,492 | B2 | 10/2008 | Ohkawa | |
| 7,445,370 | B2 | 11/2008 | Ohkawa | |
| 7,607,799 | B2 | 10/2009 | Ohkawa | |
| 7,621,657 | B2 | 11/2009 | Ohkawa | |
| 7,798,679 | B2 * | 9/2010 | Kokubo et al. | 362/335 |
| 7,819,560 | B2 * | 10/2010 | Ohkawa | 362/335 |
| 7,866,844 | B2 * | 1/2011 | Yamaguchi | 362/244 |
| 8,038,319 | B2 * | 10/2011 | Bailey | 362/245 |
| 8,585,239 | B1 * | 11/2013 | Tseng | 362/244 |
| 8,773,616 | B2 * | 7/2014 | Iiyama et al. | 349/64 |
| 2006/0044806 | A1 | 3/2006 | Abramov et al. | |
| 2006/0083000 | A1 | 4/2006 | Yoon et al. | |
| 2008/0100773 | A1 | 5/2008 | Hwang et al. | |
| 2009/0207586 | A1 | 8/2009 | Arai et al. | |
| 2010/0271708 | A1 * | 10/2010 | Wilcox | 359/654 |
| 2014/0254134 | A1 * | 9/2014 | Pelka et al. | 362/92 |

FOREIGN PATENT DOCUMENTS

CN 102252267 A 11/2011

OTHER PUBLICATIONS

China Office Action dated Jul. 23, 2014.
English translation of abstract of CN 102252267 A (published Nov. 23, 2011).

* cited by examiner

*Primary Examiner* — Anh Mai
*Assistant Examiner* — Arman B Fallahkhair
(74) *Attorney, Agent, or Firm* — Muncy, Geissler, Olds & Lowe, P.C.

(57) ABSTRACT

A light source device includes a lens and a light source disposed under the lens. The lens has a light-emitting top surface and a bottom surface opposite to the light-emitting top surface. The bottom surface concaves towards the light-emitting top surface to form a hole and has a gouge surrounding the hole with an inclination towards the edge of the hole. The hole is formed from the surrounding of a first inner wall surface and a second inner wall surface. The light source is disposed below the bottom surface and corresponds to the hole.

21 Claims, 17 Drawing Sheets

LIGHT SOURCE DEVICE

BACKGROUND OF THE INVENTION

1. Field of the Invention

The present invention generally relates to a light source device; particularly, the present invention relates to a light source device that has an external lens.

2. Description of the Related Art

Within various technical fields, especially to the field of display technology and illumination equipments, the design of light sources has always been an important aspect of light sources. Conventional light sources typically utilize light bulbs or incandescent tubes as light sources. As the technology of light-emitting diodes (LED) has matured and since LEDs have advantages of being small and being environmentally friendly by saving energy, LEDs have gradually become a mainstay on the market.

In order to increase the illumination area in practical usage, the conventional light source as shown in FIG. 1 has a lens 10 disposed and covering on top of a light-emitting diode chip 30. As shown in FIG. 1, an empty cavity 11 is formed within the lens 10 to accommodate the light-emitting diode chip 30. The top of the lens 10 forms a recess 13 that is directly above the light-emitting diode chip 30. In this design, the angle at which light is emitted is determined by an outer surface 15 of the lens 10 so that a relatively larger light-emitting area may be obtained.

However, the distribution of light produced by the above design will typically form ring shaped areas of strong light. In other words, the light will not be smooth. In addition, since the light-emitting diode chip 30 is completely covered within the cavity 11, there will be heat dissipation problems.

SUMMARY OF THE INVENTION

It is an object of the present invention to provide a light source device that emits light with higher smoothness.

It is another object of the present invention to provide a light source device that has favorable heat dissipation properties.

The light source device includes a lens and a light source. The lens has a light-emitting top surface and a bottom surface, wherein the light-emitting top surface and the bottom surface are connected by an outer wall surface. The bottom surface concaves to form a hole, wherein the hole is formed from the surrounding of a first inner wall surface and a second inner wall surface with an opening above the bottom surface. The light-emitting top surface is a flat surface.

The light source is disposed below the bottom surface and corresponds to the opening of the hole and has an illumination area directed towards the hole. The opening of the hole covers a projection area of the illumination area onto the bottom surface such that the light emitting from the illumination area may be completely or substantially emitted into the hole through the opening.

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENT

The present invention provides a light source device. In a preferred embodiment, the light source device is a light-emitting diode (LED) light source device. However, in other different embodiments, the light source device may also utilize other light sources that have an illumination area.

Figure 1:
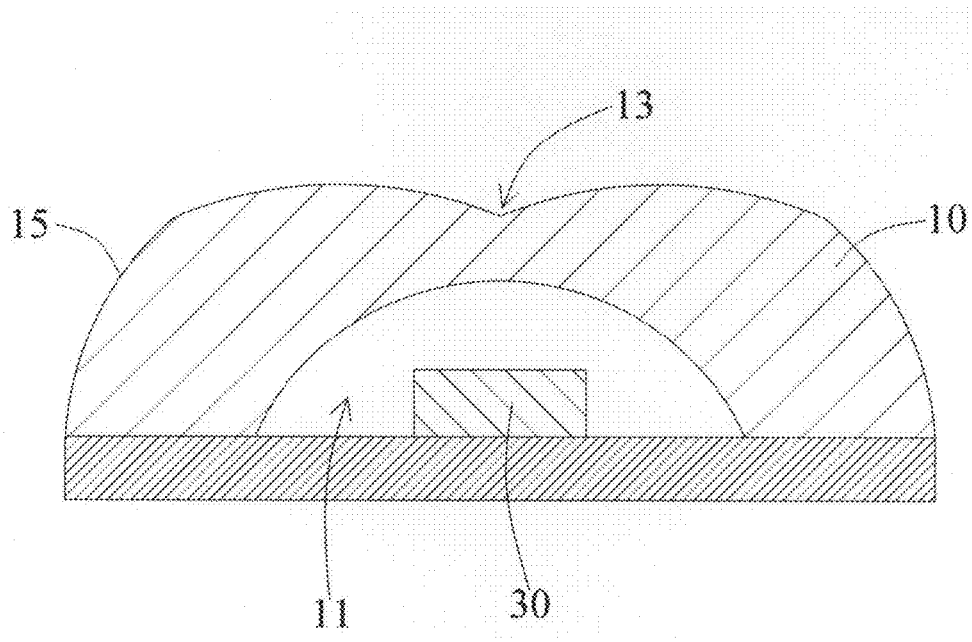
FIG. 1 (PRIOR ART)
FIG. 1 is a view of the conventional light source device.
Figure 2:
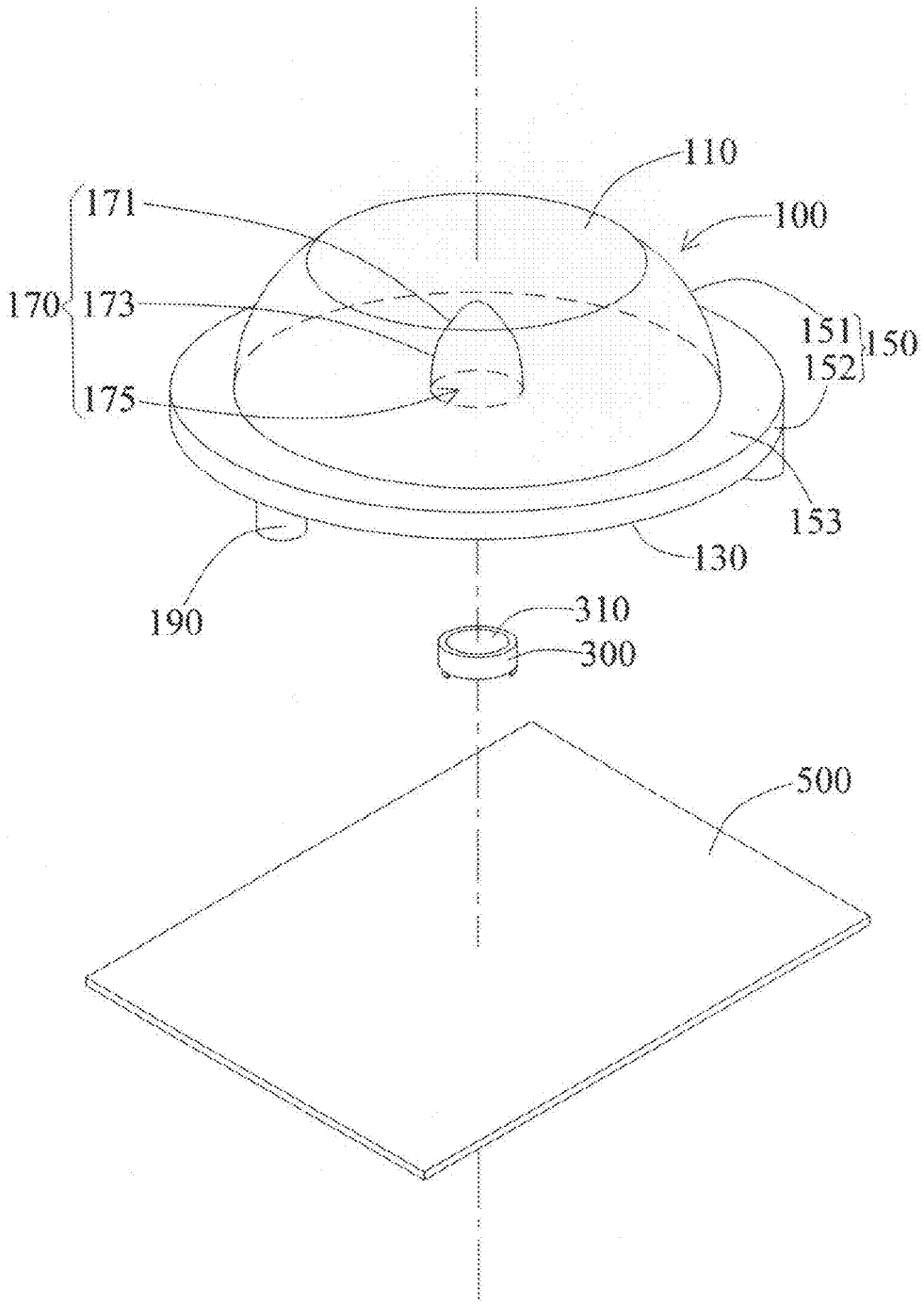
FIG. 2 is an exploded view of an embodiment of the light source device of the present invention.
Figure 3A:
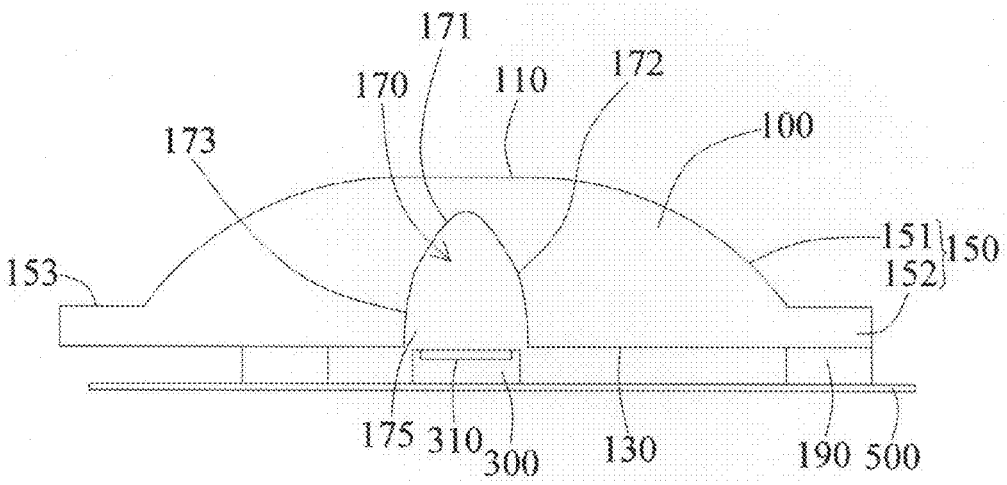
FIG. 3A is a cross-sectional view of an embodiment of the light source device.

As shown in FIGS. 2 and 3A, the light source device includes a lens 100 and a light source 300. The lens 100 has a light-emitting top surface 110, a bottom surface 130 opposite to the light-emitting top surface 110, and an outer wall surface 150 extending and connecting from the bottom surface 130 to the light-emitting top surface 110. The lens 100 preferably is formed of a transparent material, such as transparent plastic or glass. For instance, the lens 100 may be formed of polycarbonate (PC), Polymethyl Methacrylate (PMMA), or the like. However, in other different embodiments, the lens 100 may also be formed from materials with light transmittance properties, wherein there may be an inclusion of different types of particles. In the present embodiment, the light-emitting top surface 110 and the bottom surface 130 are in the shape of a circle. However, in other different embodiments, the light-emitting top surface 110 and the bottom surface 130 may also be in the shape of a hexagon or any other polygon. The light-emitting top surface 110 may also be a circular shape while the bottom surface 130 is of a hexagonal shape (or vice-versa).

The light-emitting top surface 110 is preferably smaller than the bottom surface 130, wherein the outer wall surface 150 is formed from a dome portion 151 and a brim portion 152. The light-emitting top surface 110 is preferably a flat surface disposed on the top of the dome portion 151. The dome portion 151 preferably forms a convex curvature to make the top half of the entire structure of the lens 100 to be essentially a convex structure. The brim portion 152 extends out from the bottom of the dome portion 151 and has a top brim surface 153 opposite the bottom surface 153. In an embodiment, the top brim surface 153 is a flat surface parallel to the light-emitting top surface 110. However, in other embodiments, the top brim surface 153 may be inclined with respect to the light-emitting top surface 110 or may be a non-flat surface. The outer edge of the top brim surface 153 preferably has the same shape formed by the outer edge of the bottom surface 130. For instance, in the present embodiment, the outer edge of the bottom surface 130 forms a circular shape. The outer edge of the top brim surface 153, therefore, also has the same circular shape as the bottom surface 130 such that the projection of the outer edge of the top brim surface 153 onto the bottom surface 130 essentially overlaps with the outer edge of the bottom surface 130. However, in other different embodiments, the outer edge of the top brim surface 153 may form shapes different from the outer edge of the bottom surface 130 or may have different dimensions such that the projection of the outer edge of the top brim surface 153 onto the bottom surface 130 does not overlap with the outer edge of the bottom surface 130.

As shown in FIG. 3A, a hole 170 recessed and concaved towards the light-emitting top surface 110 is formed above the bottom surface 130. The hole 170 is formed from the surrounding of a first inner wall surface 171 and a second inner wall surface 173. The first inner wall surface 171 is connected on top of the second inner wall surface 173. In other words, the first inner wall surface 171 is connected to the second inner wall surface 173 at the portion to the hole 170 that is relatively closer to the light-emitting top surface 110. An opening 175 is formed from the hole 170 being surrounded by the second inner wall surface 173 on the bottom surface 130. The second inner wall surface 173 and the opening 175 are preferably circular shapes. However, in other different embodiments, the second inner wall surface 173 and the opening 175 may also be hexagonal shaped or any other shape. As shown in FIG. 3A, the portion of the first inner wall surface 171 closest to the light-emitting top surface 110 is a curved recess. However, in other different embodiments, the portion of the first inner wall surface 171 closest to the light-emitting top surface 110 may be formed differently, such as a flat surface.

As shown in FIGS. 2 and 3A, the light source 300 is disposed below the bottom surface 130 of the lens 100 and corresponds to the hole 170. In a preferred embodiment, the light source 300 is disposed below the opening 175 of the hole 170. However, in other different embodiments, the light source 300 may also be disposed in line with the opening 175 of the hole 170. The light source 300 is preferably a light-emitting diode (LED). However, in other different embodiments, the light source 300 may also be of other types of directional or partially directional light-emitting devices. The light source 300 has an illumination area 310 directed towards the hole 170. The opening 175 of the hole 170 covers the projection area of the light emitted from the illumination area 310 onto the bottom surface 130. Through this design, light emitted out from the illumination area 310 may be completely emitted or substantially be emitted into the hole 170 through the opening 175.

In addition, in the present embodiment, the light source device further includes a substrate 500. The light source 300 is disposed on the substrate 500, wherein the lens 100 is also supported by the substrate 500. In other words, the lens 100 is not directly connected to the light source 300. In a preferred embodiment, the substrate 500 is a flexible or hard circuit board. Preferably, there is a space between the illumination area 310 of the light source 300 and the bottom surface 130 of the lens 100, wherein this space may help dissipate heat and provide an air layer as an interface layer for transmission of light. However, in other different embodiments, the lens 100 may also be connected directly to an outer side, or any other portion, of the light source 300 such that the opening 175 of the hole 170 corresponds to the light area 310 of the light source 300. In the present embodiment, the lens 100 includes a plurality of supports 190 disposed near the outer edge of the bottom surface 130 under the brim portion 152, connecting to the bottom surface 130. The supports 190 are disposed on the substrate 500 and connect to the substrate 500 such that there is sufficient space between the bottom surface 130 and the substrate 500 to accommodate the light source 300.

Figure 3B:
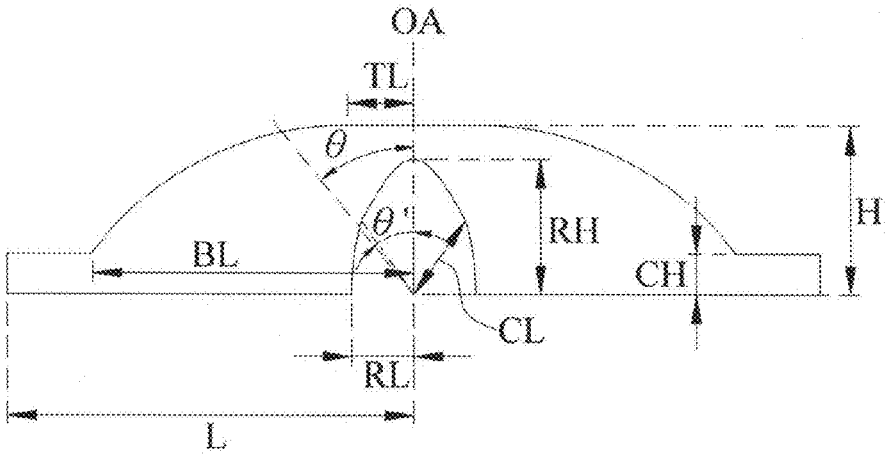
FIG. 3B is a cross-sectional view of an embodiment of the light source device.

As shown in FIGS. 3A and 3B, the first inner wall surface 171 and the second inner wall surface 173 intersect at a point 172. Both the first inner wall surface 171 and the second inner wall surface 173 may have the same or different curvature. In the present embodiment, the first inner wall surface 171 and the second inner wall surface 173 substantially forms a bullet shape. However, in other different embodiments, the first inner wall surface 171 and the second inner wall surface 173 may form other shapes. In the present embodiment, the light-emitting top surface 110 has a radius TL, while the entire lens 100 has a radius L and the opening 175 has a radius RL. The lens 100 has a height H, while the brim portion 152 has a height CH. The dome portion 151 has a radius BL, while the hole 170 has a height RH. In the present embodiment, the lens 100 has a center axis OA that runs through the center of the lens, wherein the light source 300 is preferably disposed such that the center axis OA also runs through the center of the light source 300. As well, the center axis OA preferably runs through the center of the opening 175 of the hole 170, wherein the center axis OA is the normal line to the center of the opening 175 of the hole 170. However, in other different embodiments, the center axis OA may still run through the center of the opening 175 without actually being the normal line to the opening 175. For example, if the opening 175 itself were to be inclined in relation to the center axis OA, the center axis OA would not be the normal line to the opening 175. In the present embodiment, the angle between the center axis OA through the center of the opening 175 and the line through the intersection point 172 from the center of the opening 175 is defined by an angle θ'. The angle θ is defined by the inverse tangent of the ratio RL/RH. In the present embodiment, angle θ' is preferably between 1° and 85°. In this instance when angle θ' is less than angle θ, length CL is less than height H; when angle θ' is greater than or equal to angle θ, length CL is less than radius L.

Figure 4A:
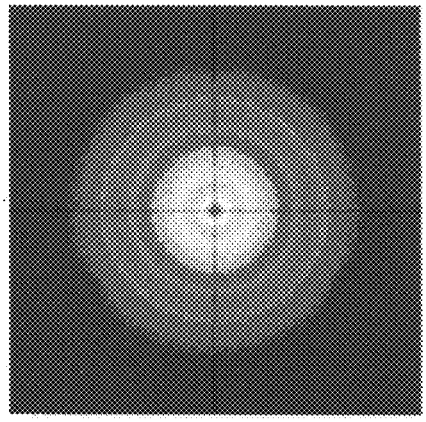
FIGS. 4A-4C are embodiments of the distribution of the illuminance of the light source device.
Figure 4B:
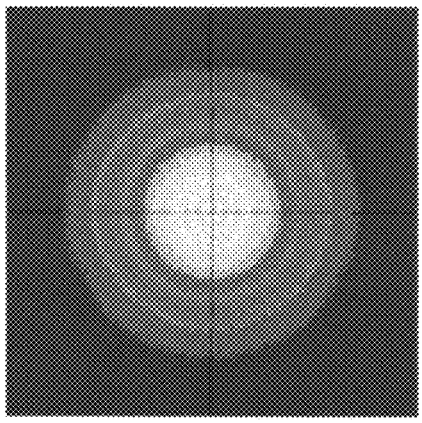
Figure 4C:
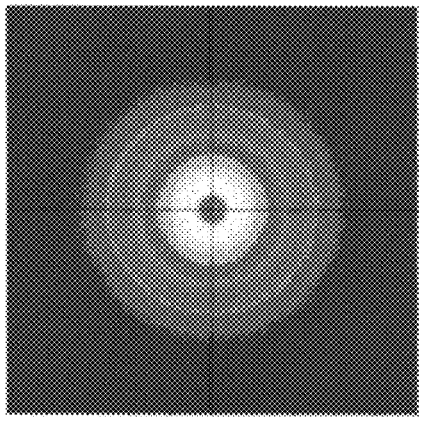

FIGS. 4A-4C illustrate the distribution of the illuminance in relation to changes in the angle θ', wherein each color represents different levels of the illuminance. The light intensities are categorized from strongest to weakest as follows: white, violet, blue, green, yellow, and then red. As shown in FIG. 4A, when angle θ' is less than 1°, a dark circle appears. This dark circle phenomenon cannot be corrected while the angle θ' is still less than 1°. FIG. 4B illustrates the light distribution when angle θ' is greater than or equal to 1°, but less than or equal to 85°. As seen from the figure, the light is evenly distributed sans the dark circle of FIG. 4A. FIG. 4C illustrates the light distribution when angle θ' is greater than 85°. In this instance, in comparison to FIG. 4B, a dark spot appears in the center while the entire light distribution is smaller in scope. As such, to achieve the greatest light distribution smoothness and scope in the present embodiment, angle θ' is preferably greater than or equal to 1°, but less than or equal to 85°.

Figure 5A:
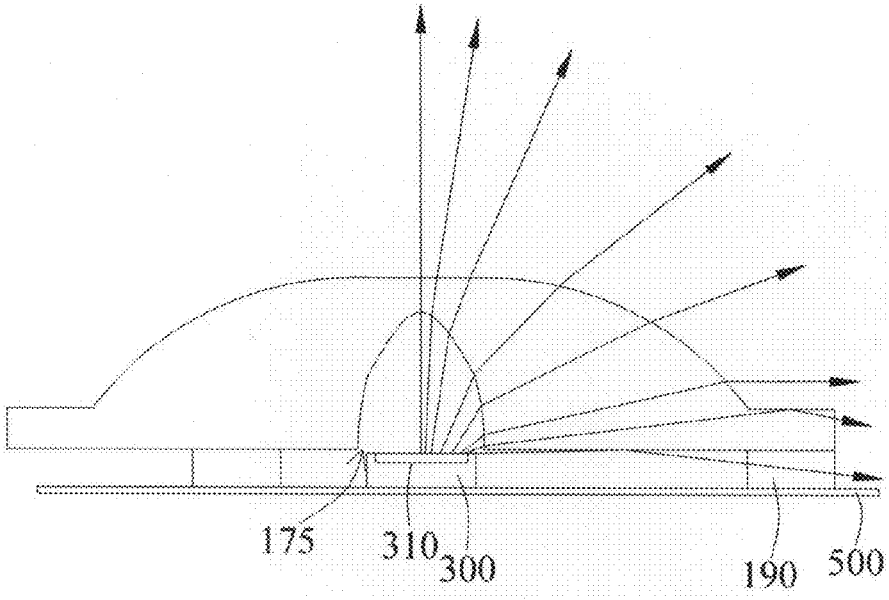
FIG. 5A is an embodiment of the light passage path through the light source device.

As shown in FIG. 5A, light generated by the light source 300 and emitted out from the illumination area 310 is emitted into the hole 170 through the opening 175. The light then enters the lens 100 through the first inner wall surface 171 or the second inner wall surface 173. As can be seen in FIG. 5A, when the light travels directly upward and passes through the top of the recess of the first inner wall surface 171, the light substantially passes through parallel to the normal line of the illumination area 310 of the light source 300 such that when the light reaches the light-emitting top surface 110 of the outer wall surface 150, the light also substantially passes through the light-emitting top surface 110 parallel to the normal line of the illumination area 310 of the light source 300. When the light passes through the first inner wall surface 171 at any other angle, the light is refracted by the first inner wall surface 171. This light then travels to the outer wall surface 150 where it is then once again refracted. In this manner, light traveling through the first inner wall surface 171 from the light source 300 may be more evenly distributed. When the light travels through the second inner surface 173 instead, the light is refracted by the second inner surface 173 such that the light is either directed at the dome portion 151 or the brim portion 152 of the outer wall surface 150. In the circumstance that the light is directed at the dome portion 151 of the outer wall surface 150, the light will be refracted by the dome portion 151. In the instance that the light is directed at the brim portion 152 of the outer wall surface 150, the light will either arrive at the top brim surface 153 or a side wall of the brim portion 152. If the light arrives at the top brim surface 153 from the second inner wall surface 173, the light will be reflected downwards. However, if the light arrives at the side wall of the brim portion 152 instead, the light will pass through without substantial refraction occurring. In the case that the light does not enter the lens 100 through the first inner wall surface 171 or the second inner wall surface 173, the light will be substantially reflected by the bottom surface 130. Through the use of the first inner wall surface 171 and the second inner wall surface 173 in conjunction with the outer wall surface 150, light may be more evenly distributed without the appearance of significantly dark/bright circles or dark spots.

Figure 5B:
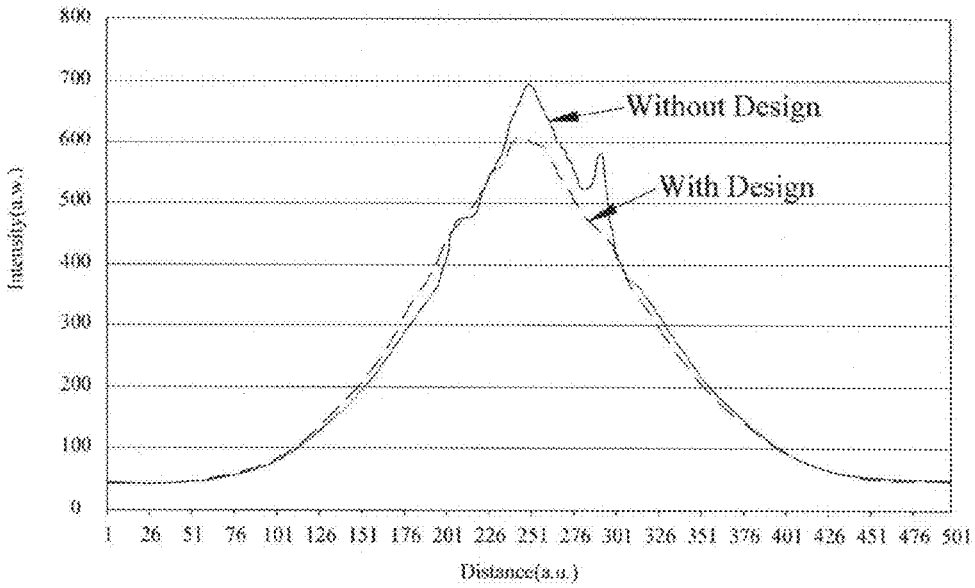
FIG. 5B is an embodiment of distribution of light intensity.

FIG. 5B illustrates the distribution of light intensities when a design modification is applied to both the outer wall surface 150 and the bottom surface 130. In one embodiment, the outer wall surface 150, the bottom surface 130, and the supports 190 may be treated according to a special design, such as treating the bottom surface 130 and the supports 190 so that the reflectivity of the bottom surface 130 and the supports 190 increases. As seen in FIG. 5B, when the distribution of the illuminance is measured for the lens 100 without the design, the lens 100 has a relatively higher spike in light intensity as indicated by the solid line graph. In comparison, when the lens 100 has the design, the distribution of light intensities follows a smoother curve as indicated by the dotted line graph. In this manner, the distribution of light of the lens 100 may be improved in relation to light smoothness though applying the special design. In addition, in other different embodiments, the substrate 500 below the bottom surface 130 may also be specially treated to raise the reflectivity such that light reflected down by the lens 100 may be reflected back up and increase the scope of the distribution of light intensities.

Figure 6A:
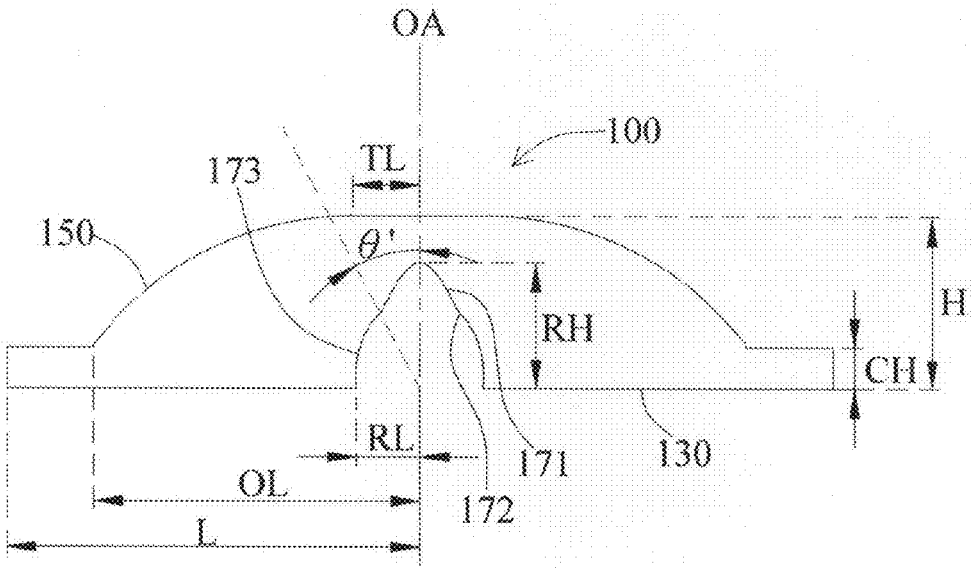
FIG. 6A is a cross-sectional view of an embodiment of the light source device.

FIG. 6A illustrates another embodiment of the lens 100 of FIG. 3A. In the embodiment of FIG. 3A, if the light source 300 used is a LED of chip-on-board (COB) type in the shape of a square or rectangle, four dark spots may appear. In order to improve on the distribution of light such that the effects of these four dark spots may be lessened or eliminated completely, the first inner wall surface 171 and the second inner wall surface 173 may be formed such that the hole 170 is substantially in the shape of a pear or a kettle gourd. In other words, the intersection point 172 between the first inner wall surface 171 and the second inner wall surface 173 concaves inward towards the hole 170.

Figure 6B:
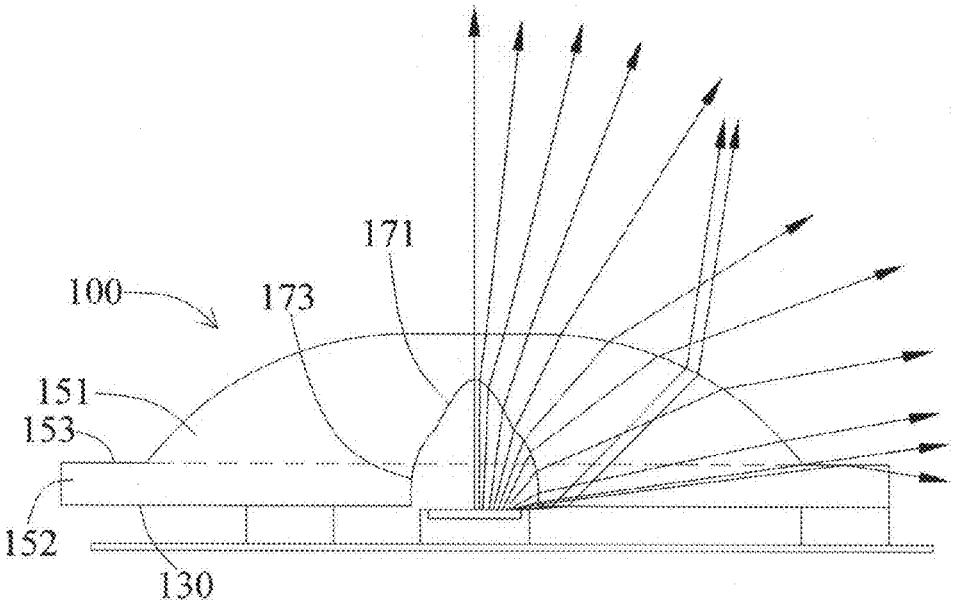
FIG. 6B is an embodiment of the light passage path through the light source device.
Figure 6C:
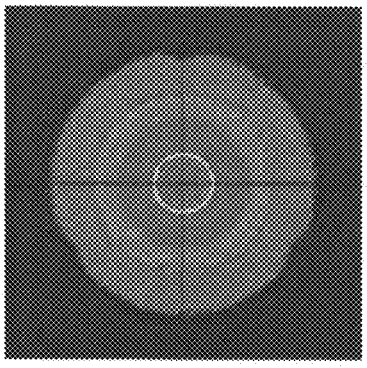
FIGS. 6C-6D are embodiments of the distribution of the illuminance of the light source device.
Figure 6D:
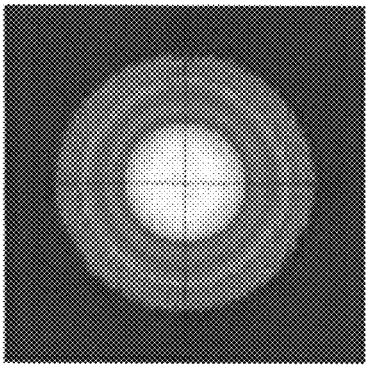

FIG. 6B illustrates an embodiment of the light passage paths through the lens 100 of FIG. 6A. As shown in FIG. 6B, when the light passes through the first inner wall surface 171, the light is first refracted by the first inner wall surface 171 and then by the dome portion 151 of the outer wall surface 150. When light passes and refracted through the second inner wall surface 173, the light is either then refracted by the dome portion 151 or reflected by the brim portion 152 of the outer wall surface 150. If light enters the lens 100 through the bottom surface 130, light will be refracted upwards through the dome portion 151. In this instance, in referring to FIG. 6C, a bright circular light will be formed from the upward refracted light. However, this phenomenon may be improved on or corrected by applying the special design mentioned previously to the bottom surface 130 and the supports 190 in order to raise the reflectivity of their respective surfaces, as seen in FIG. 6D. It should be noted that the kettle gourd structure formed by the first inner wall surface 171 and the second inner wall surface 173 is not restricted to being used with LED of square COB type, as round LED's or any other types of light sources may be used in conjunction with the kettle gourd structure to improve on the smoothness of the illuminance.

Figure 7A:
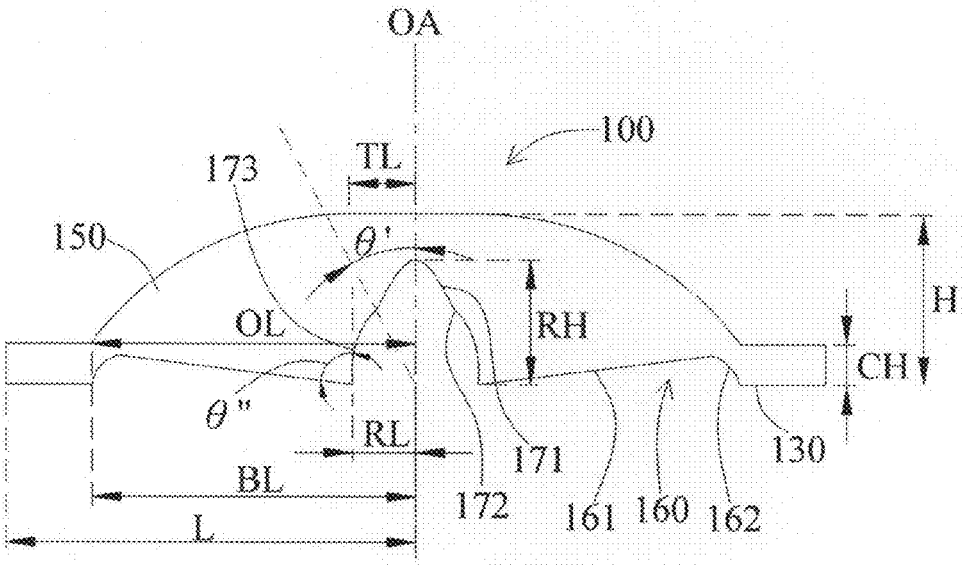
FIG. 7A is a view of an embodiment of the light source device having the kettle gourd structure and the gouge.
Figure 7B:
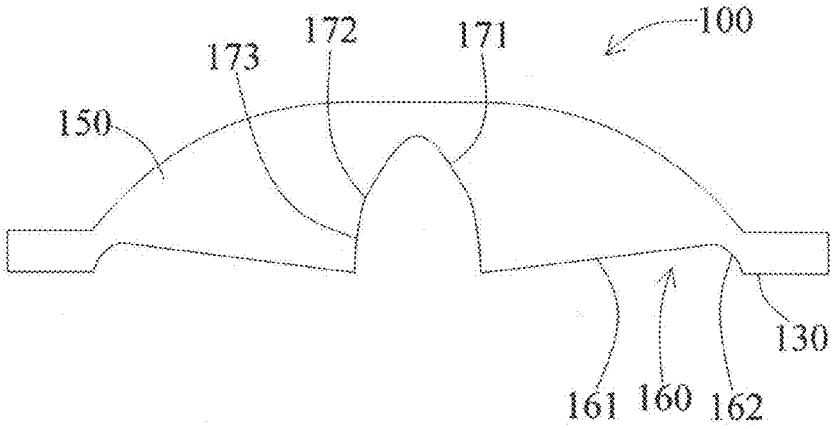
FIG. 7B is a view of an embodiment of the light source device having the bullet structure and the gouge.

FIG. 7A is an embodiment of the bottom surface 130 having a gouge 160. The gouge 160 is introduced as a means to increase the range of the distribution of light such that light may be distributed over a greater area. As shown in FIG. 7A, the bottom surface 130 may have the gouge 160, wherein the gouge 160 surrounds the opening 175 of the hole 170. In the present embodiment, the gouge 160 has an inclination 161, wherein the inclination 161 is substantially a flat or straight line surface that is inclined towards the opening 175. In more definite terms, the inclination 161 begins at the bottom of the gouge 160 and inclines towards the edge of the opening 175. At the other end of the gouge 160 closer to the sidewalls of the brim portion 152, the inclination 161 preferably exits the gouge through a curve 162. However, in other different embodiments, other different shapes may be utilized instead of the curve 162. The gouge 160 may also utilize other non-flat or non-straight inclination methods different from the flat inclination 160. As seen in FIG. 7A, in the present embodiment, the length BL measuring the point at which the gouge 160 ends farthest away from the center axis OA is preferably the same as the radius OL of the dome portion 151. In this manner, the gouge 160 substantially ends at roughly the same distance away from the center axis OA as the dome portion 151, such that the brim portion 152 can be seen extending out thereafter. In the present embodiment, the gouge 160 is utilized in conjunction with the kettle gourd structure of the first inner wall surface 171 and the second inner wall surface 173. However, as seen in FIG. 7C, the bullet structure of FIG. 3A may also be utilized in conjunction with the gouge 160.

In the present embodiment, angle θ" is defined by the angle between the inclination 161 and the normal line parallel to the center axis OA at the intersection of the inclination 160 and the edge of the opening 175. In a preferred embodiment, when the kettle gourd structure of the first inner wall surface 171 and the second inner wall surface 173 is used in conjunction with the gouge 160, the angle θ' is preferably between 10° and 80°, while the angle θ" is preferably between 70° and 85°.

Figure 7C:
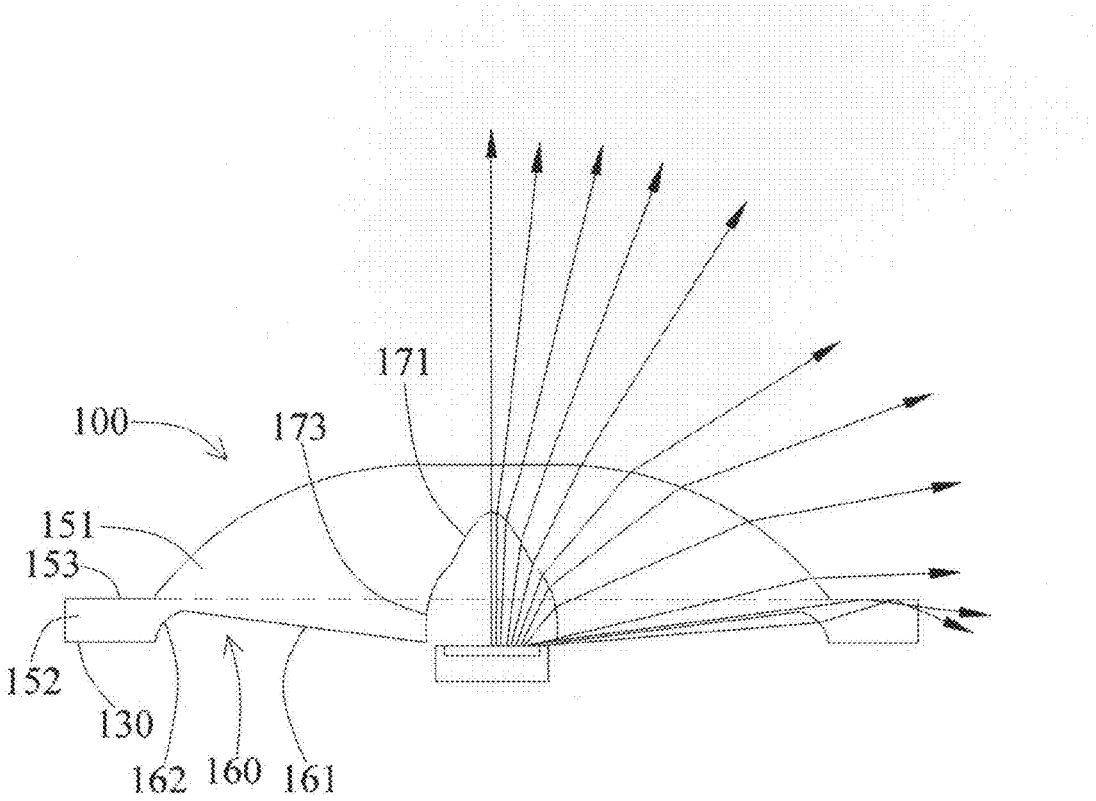
FIG. 7C is an embodiment of the light passage path through the light source device.
Figure 7D:
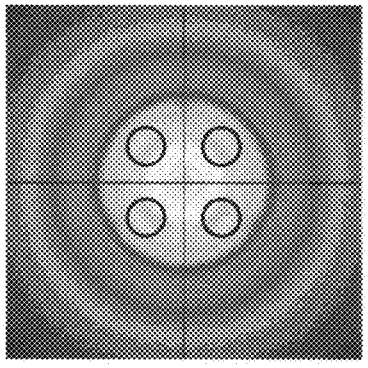
FIGS. 7D-7E are embodiments of the distribution of the illuminance of the light source device.
Figure 7E:
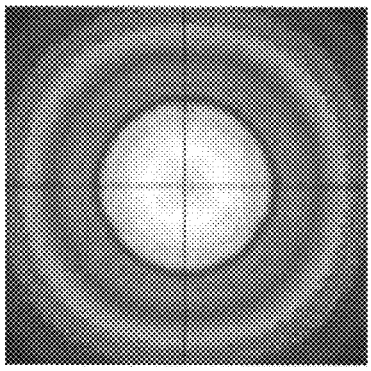

FIG. 7C illustrates an embodiment of the light passage path through the lens 100 when the kettle gourd structure is utilized in conjunction with the gouge 160. As shown in FIG. 7C, the gouge 160 with the inclination 161 substantially allows light that would normally be reflected by the flat bottom surface 130 to enter the gouge 160 and be refracted towards the brim portion 152, wherein the refracted light would then either be reflected downwards by the top brim surface 153 or refracted out the sidewall of the brim portion 152. Through this design, the distribution of the illuminance may be increased in range. FIG. 7D illustrates the distribution of the illuminance of the lens 100 utilizing a bullet structure hole 170 in conjunction with the gouge 160. In comparison to distribution of the illuminance shown in FIG. 4B of FIG. 3A, the gouge 160 increases the range at which light may be distributed. However, in this current example, the light source 300 utilizes a square COB type of LED, which results in the appearance of the mentioned four dark spots as indicated by the circles when the bullet structure hole 170 is used. FIG. 7E illustrates the distribution of the illuminance of the lens 100 of FIG. 7C, wherein the lens 100 utilizes the kettle gourd structure in conjunction with the gouge 160. In comparison to FIG. 7D, the distribution of the illuminance has substantially the same range as FIG. 7D, but since FIG. 7E also utilizes the kettle gourd structure, the effects of the four dark sports created from the use of the square COB type LED's have been dramatically lessened such that the light intensities are more evenly distributed.

Figure 8A:
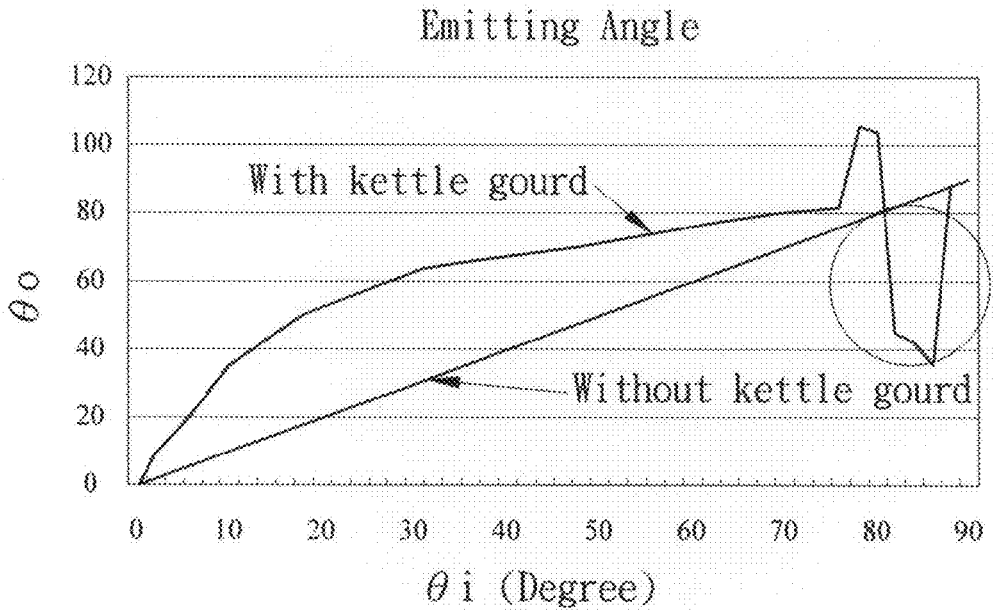
FIGS. 8A-8E are embodiments of the ratio of the emitting angle over the incident angle.
Figure 8B:
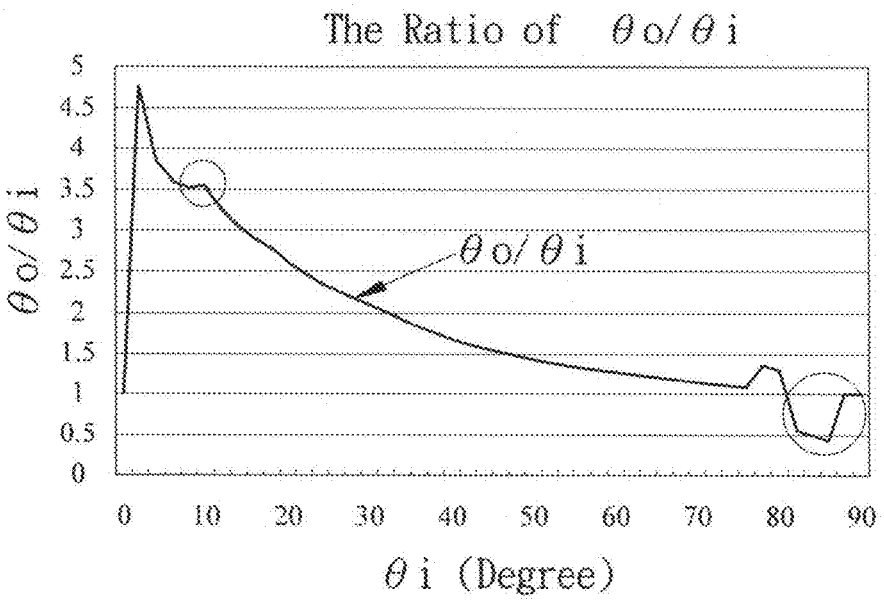
Figure 8C:
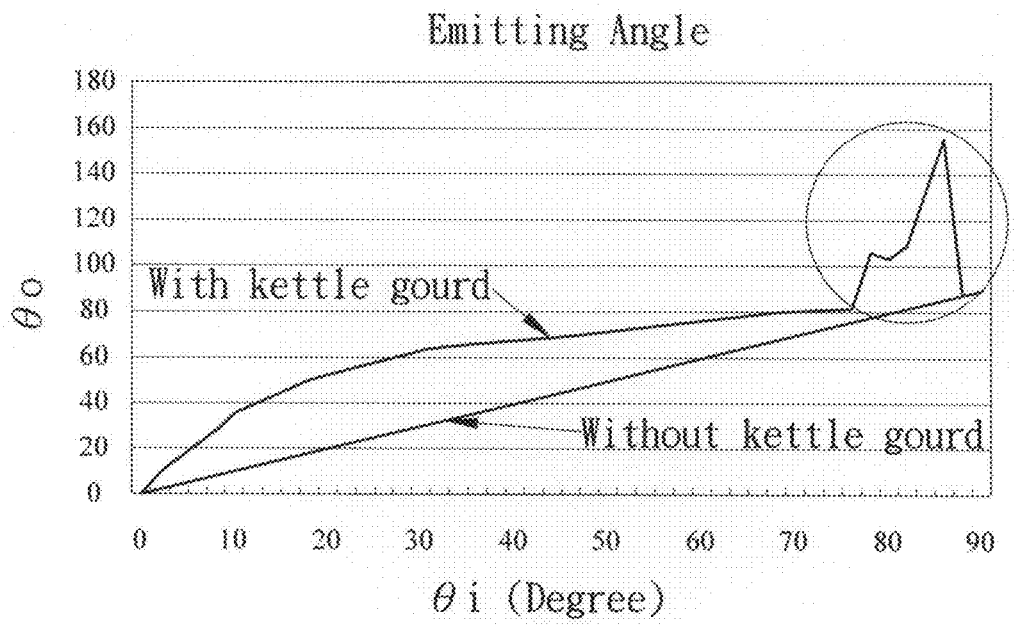
Figure 8D:
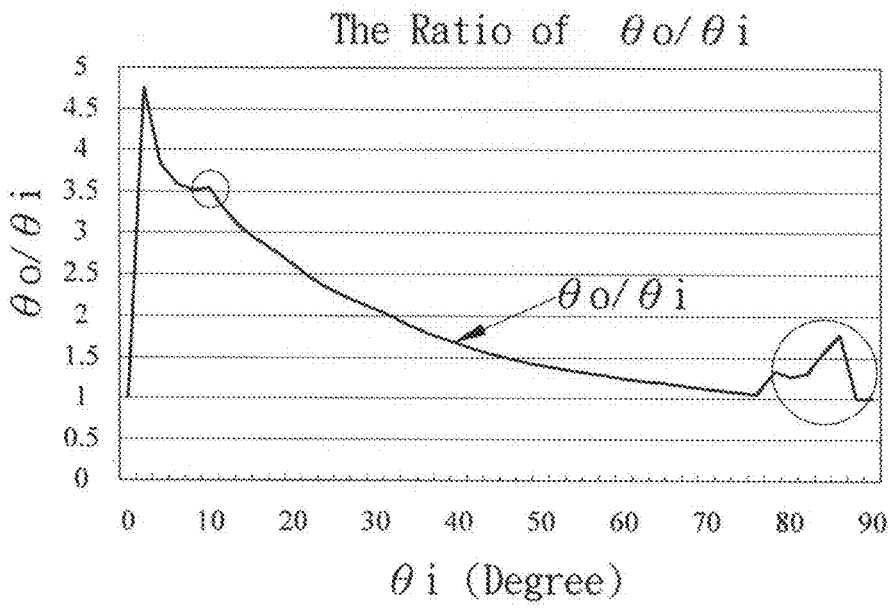
Figure 8E:
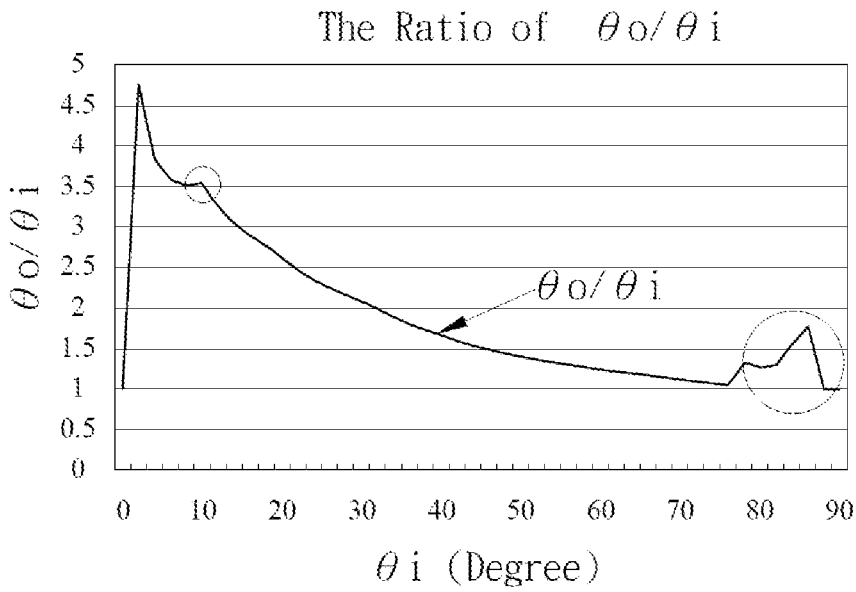

FIGS. 8A-8D illustrate the relationships between an angle $\theta_i$ of the light arriving at the first or second inner wall surface (171, 173) and an angle $\theta_o$ of the same light being refracted by the outer wall surface 150. In other words, angle $\theta_i$ is defined by the angle between the light arrive at the first or second inner wall surface (171, 173) and the normal line to the center of the hole 170. On the other hand, angle $\theta_o$ is defined by the angle between normal line to the center of the hole 170 and the refracted light emitted out of the outer wall surface 150 of the same light. FIGS. 8A and 8B depict the lens 100 without the mentioned special design applied to the bottom surface 130 and the supports 190. FIGS. 8C and 8D depict the lens 100 with the mentioned special design applied to the bottom surface 130 and the supports 190. For comparison's case, the lenses 100 in these examples are assumed to have a flat bottom surface 130 (sans gouge 160). As shown in FIG. 8A, the graph illustrates the relationship between $\theta_o$ and $\theta_i$. As shown in FIG. 8A, two lines are illustrated to respectively correspond to the relationship between $\theta_o$ and $\theta_i$ without the external lens and the relationship between $\theta_o$ and $\theta_i$ with the external lens that does not have the special design on the bottom surface 130. As can be seen by the graph, as $\theta_i$ increases, there is a point at which $\theta_o$ sharply fluctuates on the line with the external lens. On the other hand, the line without the external lens does not sharply fluctuate at all. However, in other different embodiments such as FIG. 8B, the graph may take on other shapes or forms. In FIG. 8B, two lines are illustrated to respectively correspond to the relationship between $\theta_o$ and $\theta_i$ without the external lens and the relationship between $\theta_o$ and $\theta_i$ with the external lens that has the gouge 160 design on the bottom surface 130. By studying the corresponding graph to FIG. 8A in FIG. 8C of the ratio $\theta_o/\theta_i$ to $\theta_i$ as $\theta_o$ and $\theta_i$ varies, the range of degree at which bright or dark circles appear in the variation of the light angle deepens on the line OA may be easily identified. For instance, the section with sharp rises or declines on the graph in FIG. 8C depict the degree at which $\theta_i$ is producing bright or dark spots in the lens 100. In this manner, the curvature of the first inner wall surface 171 and the second inner wall surface 173 may be adjusted to obtain a more uniform distribution of the illuminance that more closely follows the line with the external lens of FIG. 8A. In similar fashion, FIGS. 8D and 8E illustrate the same graphs of FIGS. 8A and 8C, but under the circumstance where the mentioned special design is applied to the bottom surface 130 and the supports 190.

Figure 9A:
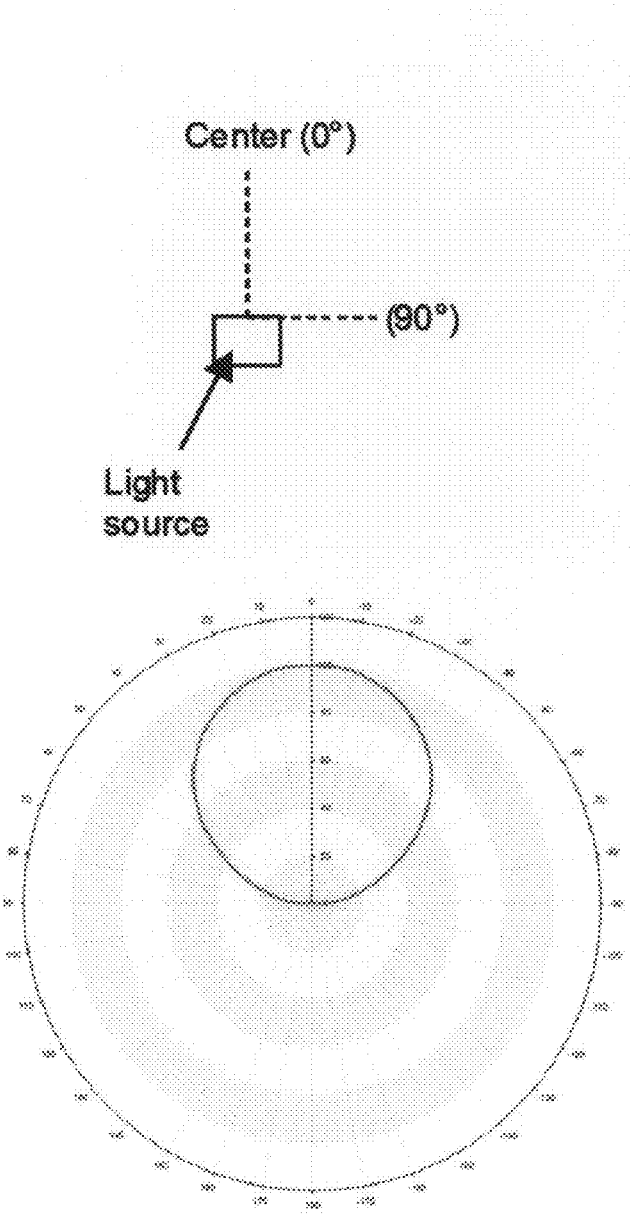
FIGS. 9A-9E are embodiments of distribution of max intensities of the light source device.
Figure 9B:
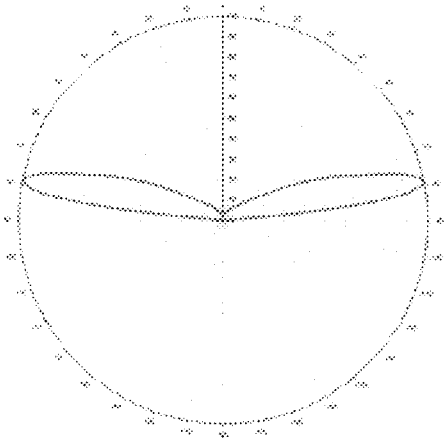
Figure 9C:
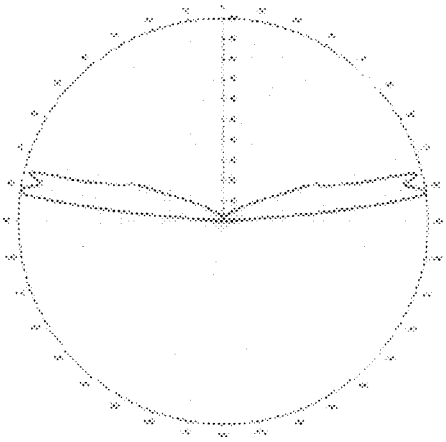
Figure 9D:
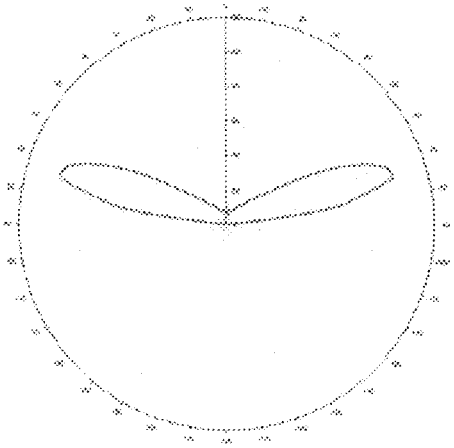
Figure 9E:
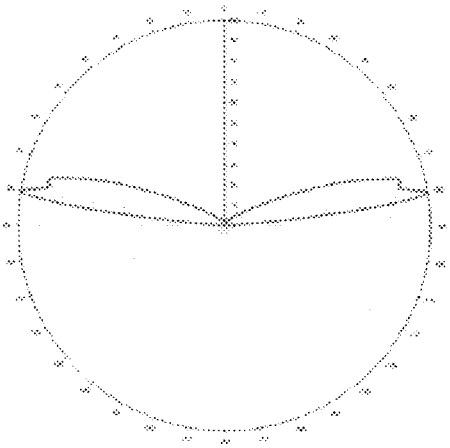

However, the distribution of the illuminance is greatly affected by the type of light source 300 that is employed as well as the material used to form the lens 100. FIG. 9A illustrates the light intensity of the light source 300 from a side view, with the normal line to the surface of the illumination area 310 (light emitting surface) of the light source 300 having an angle of 0 degree and the line parallel to the illumination area 310 of the light source 300 having an angle of 0 degree. In the present embodiment, a graph mapping the light intensities at various angles of the light source without the use of the external lens of the outer wall surface 150 is illustrated. As shown in the graph, the maximum light intensity (100%) occurs when light is emitted from the illumination area 310 of the light source 300 at 0° (center). As the angle of light emitted from the light source 300 increases, the light intensity decreases. In the preferred embodiment, the light source 300 preferably emits light such that the graph mapping the light intensities at the various angles forms a circular shape, wherein the light source 300 may be a Lambertian source. However, in other different embodiments, the light intensity graph of the light source 300 may form other different shapes. FIGS. 9B-9E illustrates examples of different combinations of lens 100 and light sources 300. FIGS. 9B and 9C illustrate the distribution of light intensities for a lens 100 formed of polycarbonate material with light source 300 of LED having a widest beam angle of 120°. Both lens 100 of FIGS. 9B and 9C have the special design applied to their respective bottom surface 130 and supports 190. However, FIG. 9B employs the flat bottom surface 130 design while FIG. 9C employs the bottom surface 130 with the gouge 160 design. As shown in FIGS. 9B and 9C, the lens 100 of FIG. 9B has a maximum light intensity (100%) at 79° while the lens 100 of FIG. 9C has a maximum light intensity at 82°. With respect to their light intensities at center (0°), the lens 100 of FIG. 9B has a light intensity of 2.96% while the lens 100 of FIG. 9C has a light intensity of 0.26%. FIGS. 9D and 9E illustrate the distribution of light intensities for light sources 300 with differing widest beam angle. Both FIGS. 9D and 9E employ lens 100 formed of PMMA material and having flat bottom surfaces 130 treated with the special design. However, the light source 300 of FIG. 9D is a LED light with widest beam angle of 120° while the light source 300 of FIG. 9E is a LED light with widest beam angle of 150°. The maximum light intensity of FIG. 9D lies at 74° while the maximum light intensity of FIG. 9E is 80.5%. As well, the light intensity at center (0°) of FIGS. 9D and 9E are 5.42% and 1.43% respectively. Each different combination of different designs of lens 100 and light source 300 will result in max intensities of light at different angles. In addition, the light intensity at the normal line to the center will also differ. In a preferred embodiment, the max intensity of light lies between 60° and 85° to the center axis (normal line of the center), while the light intensity along the center axis is preferably 0.1% to 40% of the max intensity.

Figure 10:
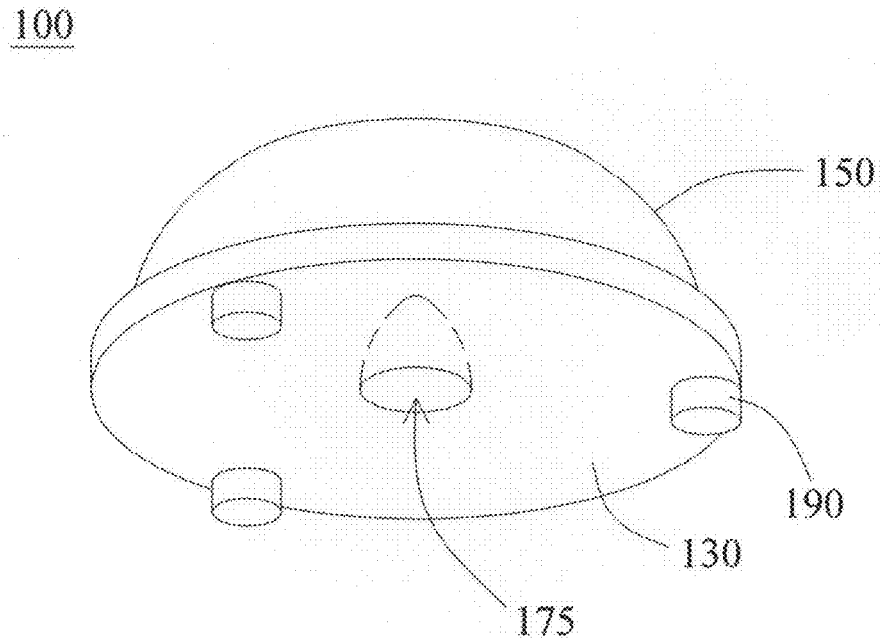
FIG. 10 is an embodiment of the light source device with a circular bottom surface.
Figure 11:
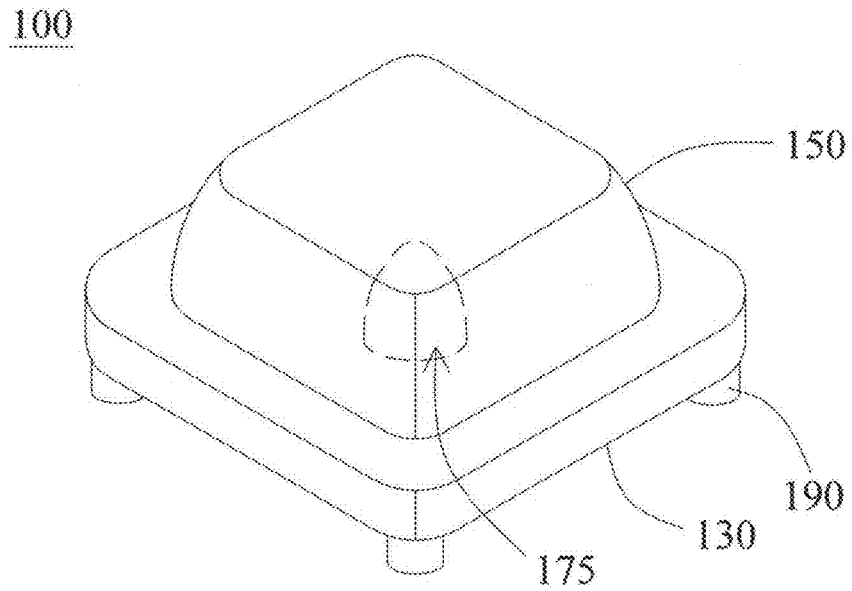
FIG. 11 is an embodiment of the light source device with a square bottom surface.
Figure 12:
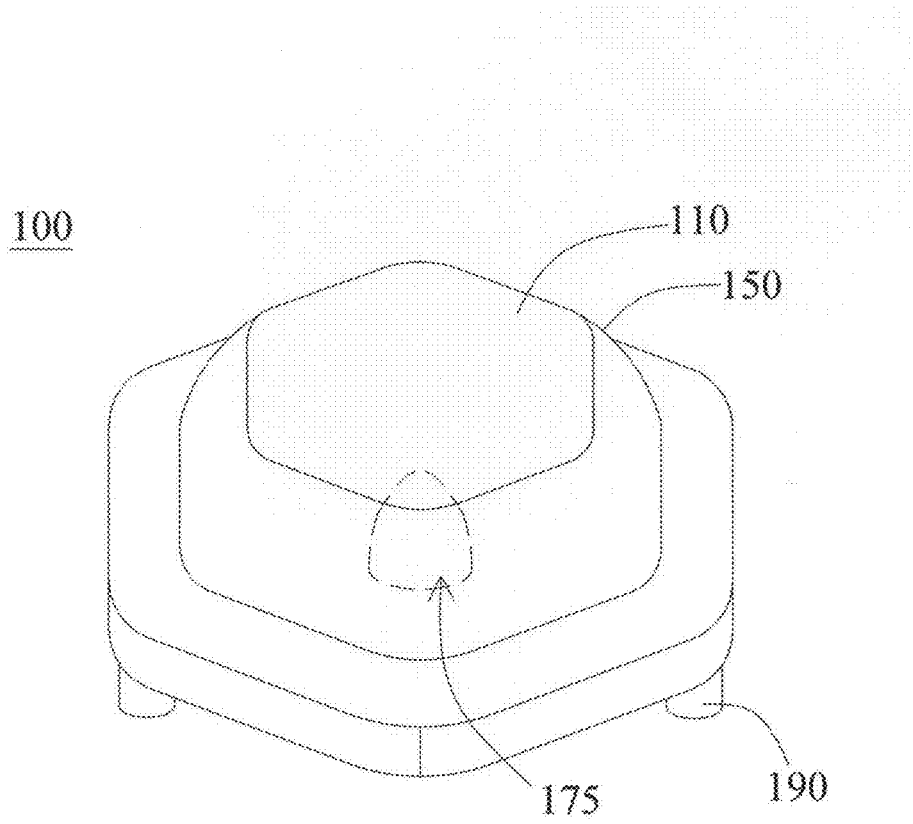
FIG. 12 is an embodiment of the light source device with a hexagonal bottom surface.

FIGS. 10 to 12 illustrate embodiments of the lens 100. It should be noted that the embodiments shown in FIGS. 10 to 12 do not include the gouge 160 for the sake of simplicity.

However, it should be understood that any feature of the lens 100 thus far mentioned may be included with these embodiments.

FIG. 10 illustrates another view of the lens 100 of FIG. 2 when viewed from below. As shown in FIG. 10, when the bottom surface 130 is a circular shape, the supports 190 are preferably spaced apart evenly and disposed on the bottom surface 130 underneath the brim portion 151. In the present embodiment, three supports 190 are utilized. However, in other different embodiments, any other suitable number of supports 190 may be used as needed in accordance to design requirements.

FIG. 11 illustrates an embodiment of the lens 100 shaped in a square shape. As shown in FIG. 11, the light-emitting top surface 110 is significantly a square shape, wherein the dome portion 151 extends down from the light-emitting top surface 110 to the brim portion 152. The brim portion 152 extends out from the dome portion 151 and is also significantly a square shape. In the present embodiment, four supports 190 are disposed at the four corners of the square shaped bottom surface 130. However, in other different embodiments, any other number of supports 190 may be used.

FIG. 12 illustrates a hexagonal shaped lens 100. In the present embodiment, the light-emitting top surface 110 has a hexagonal shape. Three supports 190 are employed, each disposed at alternating corners of the hexagonal shaped bottom surface 130. However, any other number of supports 190 may be used as needed in accordance to design requirements.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A light source device, comprising:

a lens having a light-emitting top surface which is flat and a bottom surface opposite to the light-emitting top surface, wherein the lens includes an outer wall surface extending from the bottom surface to the light-emitting top surface, wherein the outer wall surface includes a dome portion and a brim portion, the dome portion extends out from the light-emitting surface and is disposed on the brim portion, the brim portion extends out from the dome portion and extends to the bottom surface, wherein the light-emitting top surface and a top brim surface of the brim portion on the brim portion that is opposite to the bottom surface are flat surfaces, wherein the bottom surface concaves towards the light-emitting top surface to form a hole, and the bottom surface has a gouge surrounding the hole with an inclination towards the edge of the hole, and wherein the gouge has a curvature at an end of the inclination away from the hole and the curvature of the gouge substantially ends at the same distance away from a center axis as the dome portion and the curvature is lower than the top brim surface; and a light source disposed below the bottom surface and corresponding to the hole, wherein the light source has an illumination area and the hole covers a projection area of the illumination area onto the bottom surface.

2. The light source device of claim 1, wherein the hole is formed from the surrounding of a first inner wall surface and a second inner wall surface with an opening on the bottom surface.

3. The light source device of claim 2, wherein the first inner wall surface and the second inner wall surface form a kettle gourd structure.

4. The light source device of claim 3, wherein the angle between a normal line to the center of the opening and a line through the center of the opening and an intersection of the first inner wall surface and the second inner wall surface is between 10° and 80°.

5. The light source device of claim 2, wherein an angle between a normal line to the center of the hole and a point on the first inner wall surface or the second inner wall surface is defined by the inverse tangent of the ratio of a radius of the hole to a height of the hole.

6. The light source device of claim 2, wherein the first inner wall surface and the second inner wall surface form a bullet structure.

7. The light source device of claim 2, wherein an angle between a normal line to the center of the opening and a line through the center of the opening and an intersection of the first inner wall surface and the second inner wall surface is between 1° and 85°.

8. The light source device of claim 1, wherein the angle of the inclination is between 70° to 85°.

9. A light source device, comprising:

a lens having a center axis and having a light-emitting top surface, wherein the lens includes a bottom surface opposite to the light-emitting top surface, the bottom surface concaves towards the light-emitting top surface to form a hole, and the bottom surface has a gouge surrounding the hole with an inclination towards the edge of the hole, wherein the gouge has a curvature at an end of the inclination away from the hole, wherein the lens includes an outer wall surface extending from the bottom surface to the light-emitting top surface, wherein the outer wall surface includes a dome portion and a brim portion, the dome portion extends out from the light-emitting surface and is disposed on the brim portion, the brim portion extends out from the dome portion and extends to the bottom surface, wherein a top brim surface of the brim portion that is opposite to the bottom surface is a flat surface and the curvature is lower than the top brim surface, and wherein the curvature of the gouge substantially ends at the same distance away from the center axis as the dome portion; and a light source for generating light and disposed below the lens; wherein the light from the light source is refracted by the lens to cause a maximum light intensity to form between an angle greater than or equal to 60° and less than or equal to 85° from the center axis and a center light intensity along the center axis to be between 0.1% and 40% of the maximum light intensity.

10. The light source device of claim 9, wherein the hole is formed from the surrounding of a first inner wall surface and a second inner wall surface with an opening on the bottom surface.

11. The light source device of claim 10, wherein the first inner wall surface and the second inner wall surface form a bullet structure.

12. The light source device of claim 10, wherein the first inner wall surface and the second inner wall surface form a kettle gourd structure.

13. The light source device of claim 9, wherein an angle between a normal line to the center of the hole and a point on the first inner wall surface or the second inner wall surface is defined by the inverse tangent of the ratio of a radius of the hole to a height of the hole.

14. The light source device of claim 13, wherein the angle between a normal line to the center of the opening and a line through the center of the opening and an intersection of the first inner wall surface and the second inner wall surface is between 10° and 80°.

15. The light source device of claim 13, wherein an angle between a normal line to the center of the opening and a line through the center of the opening and an intersection of the first inner wall surface and the second inner wall surface is between 1° and 85°.

16. The light source device of claim 9, wherein the light-emitting top surface is a flat surface.

17. The light source device of claim 9, wherein the light source is disposed below the bottom surface corresponding to the hole, the light source has an illumination area and the hole covers a projection area of the illumination area onto the bottom surface.

18. The light source device of claim 9, wherein the dome portion, the first inner wall surface, and the second inner wall surface are curved surfaces, the curvature of the dome surface, the first inner wall, and the second inner wall increases towards the light-emitting top surface.

19. The light source device of claim 9, wherein towards the light-emitting top surface, a rate of increase in curvature of the dome surface is greater than a rate of increase in curvature of the first inner wall surface.

20. The light source device of claim 9, wherein a ratio of an emitting angle of light emitting from the light source and an incident angle of the emitting light being refracted by the outer wall surface changes as the emitting angle increases from 0° to 90° such that there is at least an interval in a range of the emitting angle where the ratio of the emitting angle between the incident angle will gradually increase before gradually decreasing.

21. The light source device of claim 9, wherein the angle of the inclination is between 70° to 85°.

* * * * *